US011078813B2

(12) United States Patent
Matsunaga

(10) Patent No.: US 11,078,813 B2
(45) Date of Patent: Aug. 3, 2021

(54) VALVE TIMING ADJUSTMENT DEVICE

(71) Applicant: DENSO CORPORATION, Kariya (JP)

(72) Inventor: Yuki Matsunaga, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/676,833

(22) Filed: Nov. 7, 2019

(65) Prior Publication Data

US 2020/0072094 A1 Mar. 5, 2020

Related U.S. Application Data

(63) Continuation of application No. PCT/JP2018/017860, filed on May 9, 2018.

(30) Foreign Application Priority Data

May 12, 2017 (JP) ..... JP2017-095403

(51) Int. Cl.
*F01L 1/344* (2006.01)

(52) U.S. Cl.
CPC ..... *F01L 1/3442* (2013.01); *F01L 2001/3444* (2013.01); *F01L 2001/34433* (2013.01)

(58) Field of Classification Search
CPC ..... F01L 1/3442; F01L 2001/34423; F01L 2001/34426; F01L 2001/3443; F01L 2001/34433; F01L 2001/3444; F01L 2001/3445; F01L 1/46
USPC ..... 123/90.17
See application file for complete search history.

(56) References Cited

U.S. PATENT DOCUMENTS 8,794,201 B2 8/2014 Eimert
2005/0034692 A1* 2/2005 Dietz ..... F01L 1/047 123/90.17
2012/0060779 A1* 3/2012 Adachi ..... F01L 1/3442 123/90.15
2012/0199086 A1* 8/2012 Hori ..... F01L 1/3442 123/90.17
2015/0059670 A1* 3/2015 Kawai ..... F01L 1/3442 123/90.15
2015/0292369 A1* 10/2015 Hayashi ..... F01L 1/3442 123/90.12
2016/0010516 A1* 1/2016 Suzuki ..... F01L 1/3442 123/90.12
2016/0076408 A1* 3/2016 Nagura ..... F01L 1/3442 123/90.15
2017/0138225 A1* 5/2017 Hamasaki ..... F01L 1/047
(Continued)

FOREIGN PATENT DOCUMENTS

JP 2014-025518 2/2014

*Primary Examiner* — Jorge L Leon, Jr.
(74) *Attorney, Agent, or Firm* — Nixon & Vanderhye P.C.

(57) ABSTRACT

A valve timing adjustment device includes a sprocket, a vane rotor and a shim. The sprocket is configured to rotate. The vane rotor is received in the sprocket such that the vane rotor is rotatable relative to the sprocket. The vane rotor includes a supply oil passage that is configured to communicate with an external oil passage, and a rotational phase of the sprocket is changed when the vane rotor is rotated relative to the sprocket. The filter is configured to filter hydraulic oil, which is conducted in a connection oil passage that is configured to connect between the external oil passage and the supply oil passage. The shim is placed between the driven shaft and the filter.

17 Claims, 16 Drawing Sheets

(56) References Cited

U.S. PATENT DOCUMENTS

2017/0183987 A1* 6/2017 Noguchi ..... F01L 1/3442
2018/0030862 A1* 2/2018 Weber ..... F01L 1/022

* cited by examiner

VALVE TIMING ADJUSTMENT DEVICE

CROSS REFERENCE TO RELATED APPLICATIONS

This application is a continuation application of International Patent Application No. PCT/JP2018/017860 filed on May 9, 2018, which designated the U.S. and claims the benefit of priority from Japanese Patent Application No. 2017-095403 filed on May 12, 2017. The entire disclosures of all of the above applications are incorporated herein by reference.

TECHNICAL FIELD

The present disclosure relates to a valve timing adjustment device.

BACKGROUND

Previously, there is known a valve timing adjustment device that is provided in a drive force transmission path, which transmits a drive force from a drive shaft to a driven shaft of an internal combustion engine, while the valve timing adjustment device adjusts a valve timing of a valve that is driven to open and close by the driven shaft.

SUMMARY

This section provides a general summary of the disclosure, and is not a comprehensive disclosure of its full scope or all of its features.

According to the present disclosure, there is provided a valve timing adjustment device that is configured to transmit a drive force from a drive shaft to a driven shaft of an internal combustion engine and is configured to adjust a valve timing of the internal combustion engine through the driven shaft. In the valve timing adjustment device, a vane rotor is received in a sprocket such that the vane rotor is rotatable relative to the sprocket. The vane rotor includes a supply oil passage that is configured to communicate with an external oil passage, and a rotational phase of the sprocket is changed when the vane rotor is rotated relative to the sprocket. A filter is placed between the external oil passage and the supply oil passage to filter hydraulic oil.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
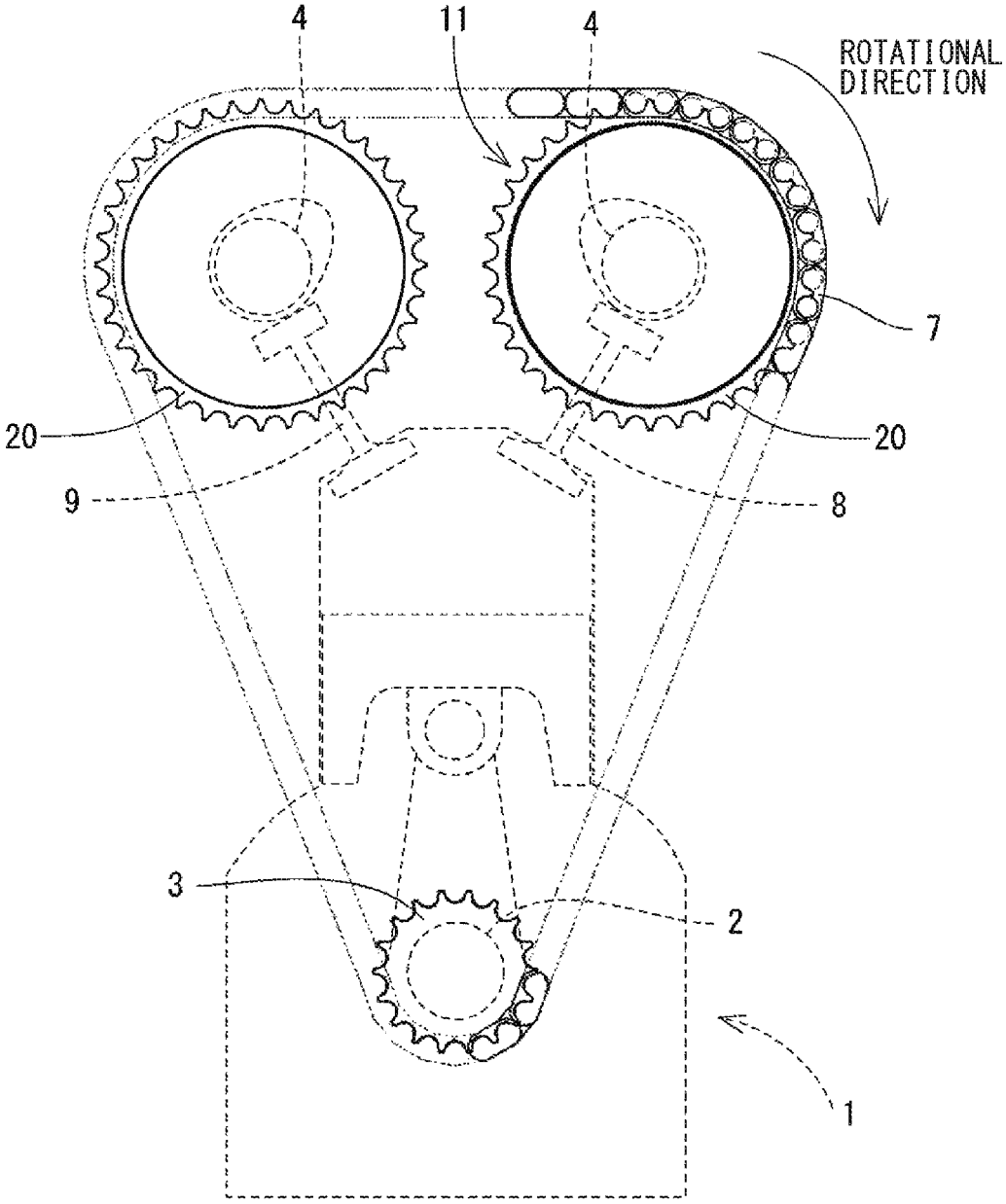
FIG. 1 is a schematic diagram of an internal combustion engine, at which a valve timing adjustment device of respective embodiments is applied.

There is known a valve timing adjustment device that is provided in a drive force transmission path, which transmits a drive force from a drive shaft to a driven shaft of an internal combustion engine, while the valve timing adjustment device adjusts a valve timing of a valve that is driven to open and close by the driven shaft. As one such valve timing adjustment device, there has been proposed a valve timing adjustment device, in which a shim is installed between the valve timing adjustment device and a driven shaft.

In this previously proposed valve timing adjustment device, the shim has projections, and the valve timing adjustment device has a groove formed at an inner surface of the valve timing adjustment device. At the time of installation, the shim is resiliently deformed in the radially inward direction, so that an outer diameter of the shim is reduced, and the deformed shim is slid along the inner surface of the valve timing adjustment device until the shim reaches the groove. Once the shim reaches the groove, the resilient deformation of the shim is relieved to enable restoration of the shim. When the resilient deformation of the shim is relieved to enable the restoration of the shim, the projections of the shim are fitted into the groove. Thereby, the shim is fitted to the valve timing adjustment device. In this structure, since the shim is slid along the inner surface of the valve timing adjustment device, friction is generated between the shim and the valve timing adjustment device, and thereby there is a possibility that abrasion particles are generated.

Furthermore, at the time of assembling the shim to the valve timing adjustment device, friction is generated between the shim and the valve timing adjustment device, or at the time of assembling the valve timing adjustment device, to which the shim is installed, to the driven shaft, friction may be generated between the driven shaft and the shim. Therefore, there is a possibility of generating abrasion particles. When the abrasion particles intrude into the valve timing adjustment device along with the hydraulic oil, the abrasion particles may be caught by the component(s) at the inside of the valve timing adjustment device. For this reason, there exists a possibility that the valve timing adjustment device has a malfunction.

According to the present disclosure, there is provided a valve timing adjustment device that is configured to transmit a drive force from a drive shaft to a driven shaft of an internal combustion engine and is configured to adjust a valve timing of the internal combustion engine through the driven shaft.

The valve timing adjustment device includes a sprocket, a vane rotor, a filter and a shim.

The sprocket is configured to rotate.

The vane rotor is received in the sprocket such that the vane rotor is rotatable relative to the sprocket. The vane rotor includes a supply oil passage that is configured to communicate with an external oil passage, and a rotational phase of the sprocket is changed when the vane rotor is rotated relative to the sprocket.

The filter is configured to filter hydraulic oil, which is conducted in a connection oil passage that is configured to connect between the external oil passage and the supply oil passage.

The shim is placed between the driven shaft and the filter and contacts the driven shaft. The shim is configured to adjust a size of a gap relative to the driven shaft.

The shim contacts the driven shaft and is configured to adjust the size of the gap relative to the driven shaft. Thereby, the assemblability with the driven shaft is improved. The shim is placed between the driven shaft and the filter. Even when abrasion particles are generated by friction between the driven shaft and the shim, the abrasion particles are captured by the filter, and thereby the hydraulic oil is filtered. Therefore, the intrusion of the abrasion particles into the inside of the valve timing adjustment device is limited, and thereby occurrence of the malfunction of the valve timing adjustment device is limited.

Hereinafter, embodiments of a valve timing adjustment device will be described with reference to the drawings. Components, which are substantially identical in the embodiments, are denoted by the same reference signs and will not be described redundantly.

First of all, an internal combustion engine 1, in which a valve timing adjustment device 11 is applied, will be described.

As shown in FIG. 1, at the internal combustion engine 1, a chain 7 is wound around a crank gear 3 and two sprockets 20 of the valve timing adjustment device 11. Here, it should be noted that a belt may be used in place of the chain 7.

The crank gear 3 is fixed to a crankshaft 2, which serves as a drive shaft of the internal combustion engine 1.

The sprockets 20 of the valve timing adjustment device 11 are respectively fixed to two camshafts 4, each of which serves as a driven shaft.

A torque is transmitted from the crankshaft 2 to the camshafts 4 through the chain 7.

One of the camshafts 4 drives a plurality of intake valves 8.

The other one of the camshafts 4 drives a plurality of exhaust valves 9.

The valve timing adjustment device 11 transmits a drive force from the crankshaft 2 to a corresponding one of the camshafts 4 at the internal combustion engine 1.

Furthermore, the valve timing adjustment device 11 adjusts an opening/closing timing of the intake valves 8 or the exhaust valves 9 by changing a relative rotational phase between the crankshaft 2 and the camshaft 4.

The camshaft 4 can be rotated in a rotational direction, which is the same as a rotational direction of the crankshaft 2, relative to the sprocket 20 that is rotated integrally with the crankshaft 2. In this way, the valve timing adjustment device 11 advances the valve timing of the intake valves 8 or the exhaust valves 9. The above-described relative rotation of the camshaft 4, which advances the valve timing of the intake valves 8 or the exhaust valves 9, is referred to as "advancing."

Furthermore, the camshaft 4 can be rotated in a rotational direction, which is opposite to the rotational direction of the crankshaft 2, relative to the sprocket 20 that is rotated integrally with the crankshaft 2. In this way, the valve timing adjustment device 11 retards the valve timing of the intake valves 8 or the exhaust valves 9. The above-described relative rotation of the camshaft 4, which retards the valve timing of the intake valves 8 or the exhaust valves 9, is referred to as "retarding."

First Embodiment

Figure 2:
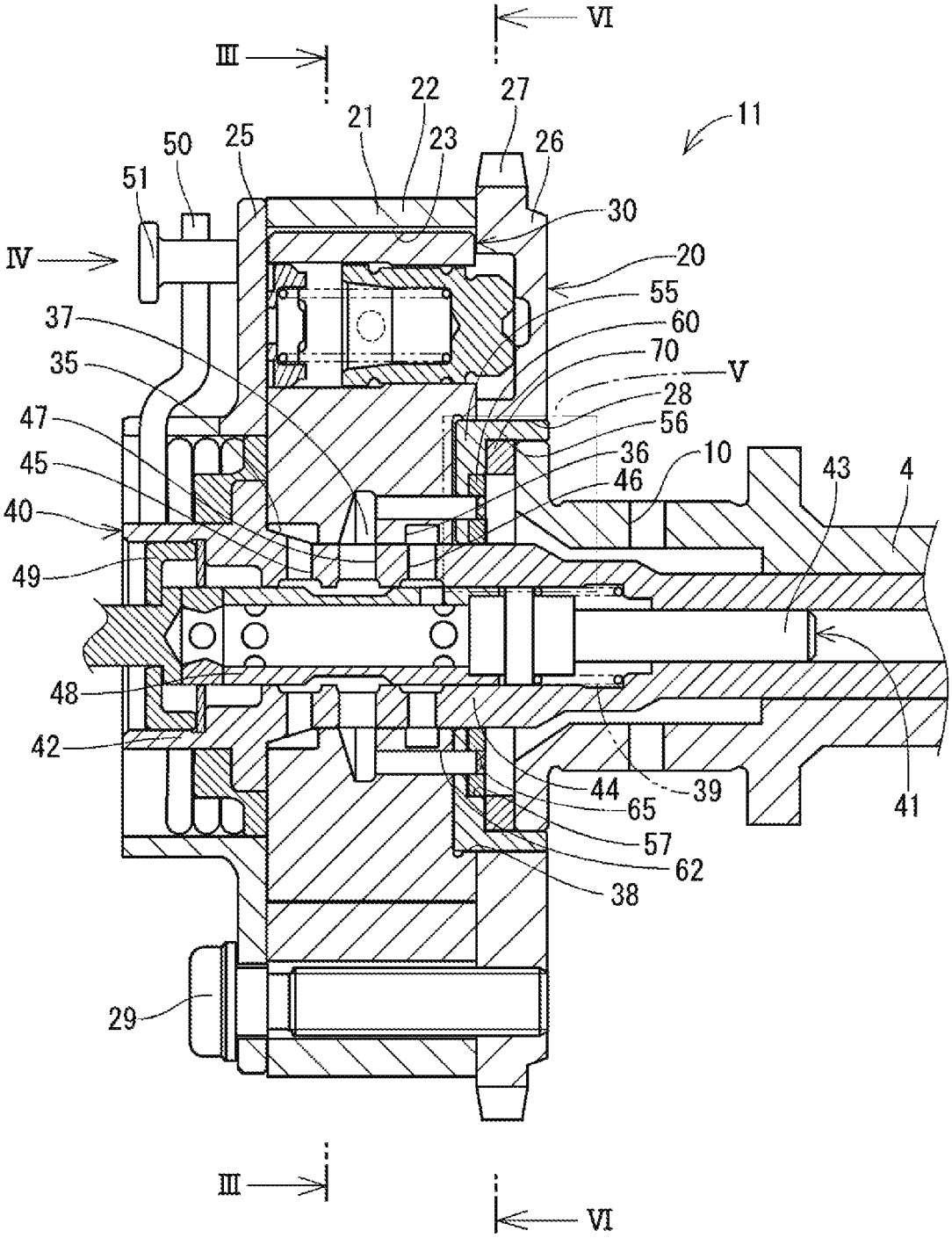
FIG. 2 is a cross-sectional view showing the valve timing adjustment device according to a first embodiment.

As shown in FIG. 2, the valve timing adjustment device 11 includes the sprocket 20, a vane rotor 30, an oil-passage change valve 40 and a retard spring 50.

The sprocket 20 includes a housing 21, a front plate 25 and a rear plate 26 and is configured to rotate integrally with the crankshaft 2.

The housing 21, the front plate 25 and the rear plate 26 are fixed together by a plurality of housing bolts 29.

The housing 21 is placed along an extension line of the axis of the camshaft 4 and is coaxial with the camshaft 4.

Furthermore, the housing 21 includes a tubular portion 22 and a plurality of housing protrusions 23.

The tubular portion 22 is shaped in a tubular form.

Figure 3:
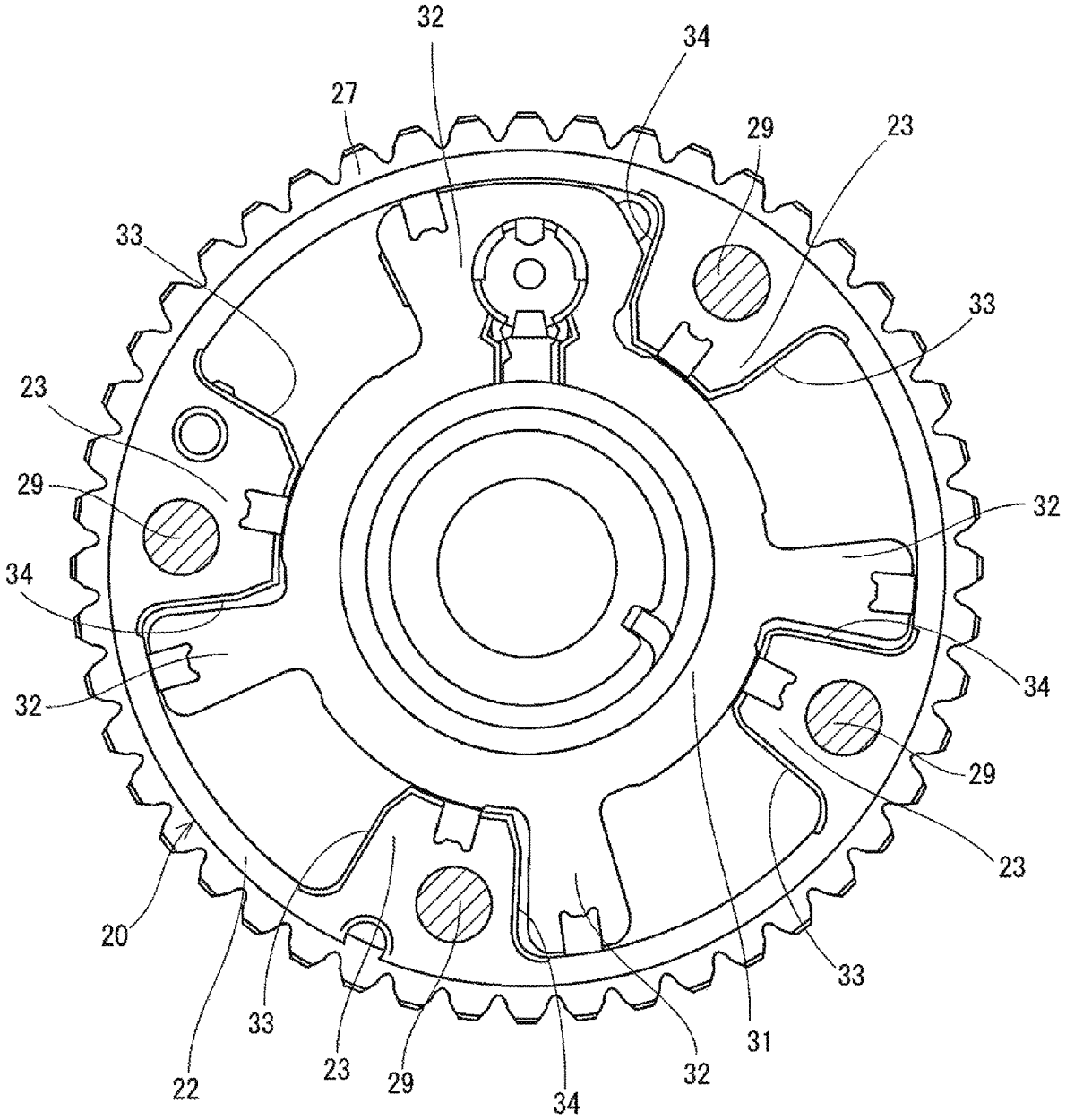
FIG. 3 is a cross-sectional view taken along line III-III in FIG. 2.

As shown in FIG. 3, each of the housing protrusions 23 inwardly protrudes from the tubular portion 22 in a radial direction of the sprocket 20.

Referring back to FIG. 2, the front plate 25 is placed at one axial side of the sprocket 20 such that the front plate 25 is placed on a side of the housing 21, which is opposite to the camshaft 4.

The rear plate 26 is placed at the other axial side of the sprocket 20 such that the rear plate 26 is on the other side of the housing 21 where the camshaft 4 is located.

The rear plate 26 includes an external teeth arrangement 27 and a rear plate hole 28.

The external teeth arrangement 27 is formed at an outer wall of the rear plate 26.

The external teeth arrangement 27 extends from a radially inner side to a radially outer side of the sprocket 20 and is connected to the crankshaft 2 through the chain 7.

The rear plate hole 28 is formed at a center of the rear plate 26 and is configured to receive a rotor fixture member 55.

The vane rotor 30 is received in the sprocket 20 and is rotatable relative to the sprocket 20.

Referring back to FIG. 3, the vane rotor 30 includes a boss 31 and a plurality of vanes 32.

The boss 31 is fixed to the camshaft 4 by a sleeve bolt 41 of the oil-passage change valve 40.

Each of the vanes 32 outwardly projects from the boss 31 in the radial direction of the vane rotor 30.

Furthermore, each of the vanes 32 partitions an inside space of the sprocket 20. Specifically, each of the vanes 32 partitions a space located between corresponding adjacent two of the housing protrusions 23 into an advance chamber 33 and a retard chamber 34.

The advance chamber 33 is located on a side of the vane 32 in a reverse-rotational direction that is a direction opposite to the rotational direction described above.

The retard chamber 34 is located on a side of the vane 32 in the rotational direction.

Referring back to FIG. 2, the vane rotor 30 further includes an advance oil passage 35, a retard oil passage 36 and a supply oil passage 37.

The advance oil passage 35 is communicated with the advance chambers 33.

The retard oil passage 36 is communicated with the retard chambers 34.

The supply oil passage 37 is opened at an end surface of the boss 31 located on the camshaft 4 side and can be communicated with an external oil passage 10 of the camshaft 4.

When the vane rotor 30 receives a pressure of hydraulic oil supplied to the advance chambers 33 or the retard chambers 34, the vane rotor 30 is rotated relative to the sprocket 20. When the vane rotor 30 is rotated relative to the sprocket 20, a rotational phase of the sprocket 20 is changed toward the advance side or the retard side.

The oil-passage change valve 40 is operable to enable and disable communication between the external oil passage 10 and the supply oil passage 37.

The oil-passage change valve 40 includes the sleeve bolt 41 and a spool 48.

The sleeve bolt 41 is inserted into the vane rotor 30 from an opposite side that is opposite to the camshaft 4, and the sleeve bolt 41 is threadably coupled to the camshaft 4.

Furthermore, the sleeve bolt 41 includes a sleeve portion 44 that is located between a head 42 and a threaded portion 43 of the sleeve bolt 41. A stopper plate 49 is placed at an inside of the head 42.

The sleeve portion 44 includes advance ports 45, retard ports 46 and supply ports 47.

The advance ports 45 are communicated with the advance oil passage 35.

The retard ports 46 are communicated with the retard oil passage 36.

The supply ports 47 are communicated with the supply oil passage 37.

The spool 48 is placed at the inside of the sleeve portion 44 and is configured to reciprocate in the axial direction of the sleeve portion 44. When the spool 48 is moved, corresponding ones of the ports of the sleeve portion 44 are connected with each other, and thereby the corresponding ones of the ports of the sleeve portion 44 are selected.

When the rotational phase of the vane rotor 30 relative to the sprocket 20 is changed to the advance side, the spool 48 connects between the supply ports 47 and the advance ports 45. At the same time, an external drain space and each retard port 46 are communicated with each other through an inside of the spool 48.

Furthermore, when the rotational phase of the vane rotor 30 relative to the sprocket 20 is changed to the retard side, the spool 48 connects between the supply ports 47 and the retard ports 46. At the same time, the external drain space and each advance port 45 are communicated with each other through an outside of the spool 48.

Furthermore, the spool 48 is urged toward the stopper plate 49 by a spring 39. An axial position of the spool 48 is determined by an urging force of the spring 39 and an urging force of a linear solenoid that is placed on a side of the stopper plate 49, which is opposite to the spring 39. The linear solenoid is not shown in the drawings for the sake of simplicity.

The retard spring 50 is shaped in a form of a coil by spirally winding a wire made of metal, such as iron or stainless steel.

Figure 4:
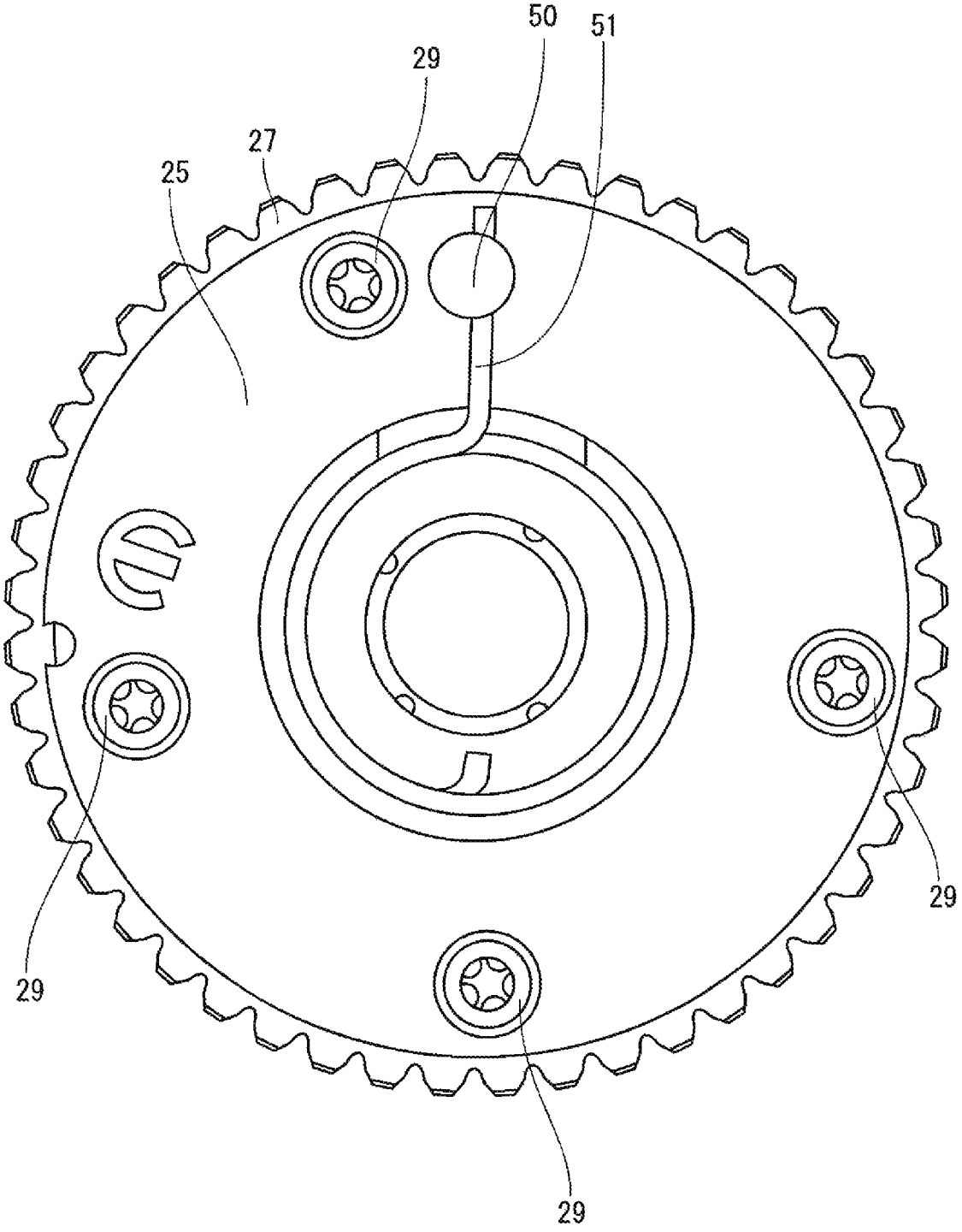
FIG. 4 is a view taken in a direction of an arrow IV in FIG. 2.

As shown in FIG. 4, one end part of the retard spring 50 is engaged with an engaging pin 51, and the other end part of the retard spring 50 is engaged with the boss 31.

The retard spring 50 urges the vane rotor 30 in the advance direction relative to the sprocket 20. The urging force of the retard spring 50 is set to be larger than an average value of fluctuation torques in the retard direction applied from the camshaft 4 to the vane rotor 30 at the time of rotating the camshaft 4. Therefore, when the hydraulic oil is not supplied to the advance chambers 33 and the retard chambers 34, the vane rotor 30 is urged in the advance direction by the retard spring 50. The vane rotor 30 is urged to a most advanced position in the advance direction by the retard spring 50.

In the valve timing adjustment device 11, when the rotational phase is on the retard side of the target value, the oil-passage change valve 40 connects the advance chambers 33 to the supply oil passage 37 and connects the retard chambers 34 to the external drain space. Therefore, the hydraulic oil is supplied to the advance chambers 33, and the hydraulic oil is discharged from the retard chambers 34 to the outside. Thus, the vane rotor 30 is rotated toward the advance side relative to the sprocket 20.

Furthermore, when the rotational phase is on the advance side of the target value, the oil-passage change valve 40 connects the retard chambers 34 to the supply oil passage 37 and connects the advance chambers 33 to the external drain space. Therefore, the hydraulic oil is supplied to the retard chambers 34, and the hydraulic oil is discharged from the advance chambers 33 to the outside. Thus, the vane rotor 30 is rotated toward the retard side relative to the sprocket 20.

Furthermore, when the rotational phase coincides with the target value, the oil-passage change valve 40 closes the advance chambers 33 and the retard chambers 34. Therefore, the current rotational phase is maintained.

In the case of the previously proposed valve timing adjustment device discussed earlier, the shim is placed between the valve timing adjustment device and the driven shaft. In this previously proposed valve timing adjustment device, the shim has the projections, and the valve timing adjustment device has the groove formed at the inner surface of the valve timing adjustment device. At the time of installation, the shim is resiliently deformed in the radially inward direction, so that the outer diameter of the shim is reduced, and the deformed shim is slid along the inner surface of the valve timing adjustment device until the shim reaches the groove. Once the shim reaches the groove, the resilient deformation of the shim is relieved to enable restoration of the shim. When the resilient deformation of the shim is relieved to enable the restoration of the shim, the projections of the shim are fitted into the groove. Thereby, the shim is fitted to the valve timing adjustment device.

In this previously proposed valve timing adjustment device, since the shim is slid along the inner surface of the valve timing adjustment device, friction is generated between the shim and the valve timing adjustment device. Therefore, the shim or the valve timing adjustment device may possibly be damaged and scraped. Thus, there is a possibility of generating the abrasion particles. Furthermore, at the time of assembling the valve timing adjustment device, to which the shim is installed, to the driven shaft, friction may be generated between the driven shaft and the shim. Therefore, the driven shaft or the shim may possibly be damaged and scraped. Therefore, there is a possibility of generating the abrasion particles. When the abrasion particles intrude into the valve timing adjustment device along with the hydraulic oil, the abrasion particles may be caught by the component(s) at the inside of the valve timing adjustment device. For this reason, there exists a possibility that the valve timing adjustment device has a malfunction.

In view of the above point, the valve timing adjustment device 11 is configured to limit the intrusion of the abrasion particles into the inside of the valve timing adjustment device 11 while enabling easy installation of the valve timing adjustment device 11 to the internal combustion engine 1.

Referring back to FIG. 2, the valve timing adjustment device 11 further includes the rotor fixture member 55, a filter holder 60, filters 65 and a shim 70.

The rotor fixture member 55 is placed between the camshaft 4 and the vane rotor 30.

The rotor fixture member 55 is press fitted into a press fitting hole 38 of the vane rotor 30 through the rear plate hole 28 and is fixed to the vane rotor 30. The rotor fixture member 55 is configured to connect with the camshaft 4.

The rotor fixture member 55 is placed to clamp the shim 70 between the rotor fixture member 55 and the camshaft 4.

Furthermore, the rotor fixture member 55 is shaped in a ring form, and the sleeve bolt 41 is inserted through an inside of the rotor fixture member 55.

Figure 5:
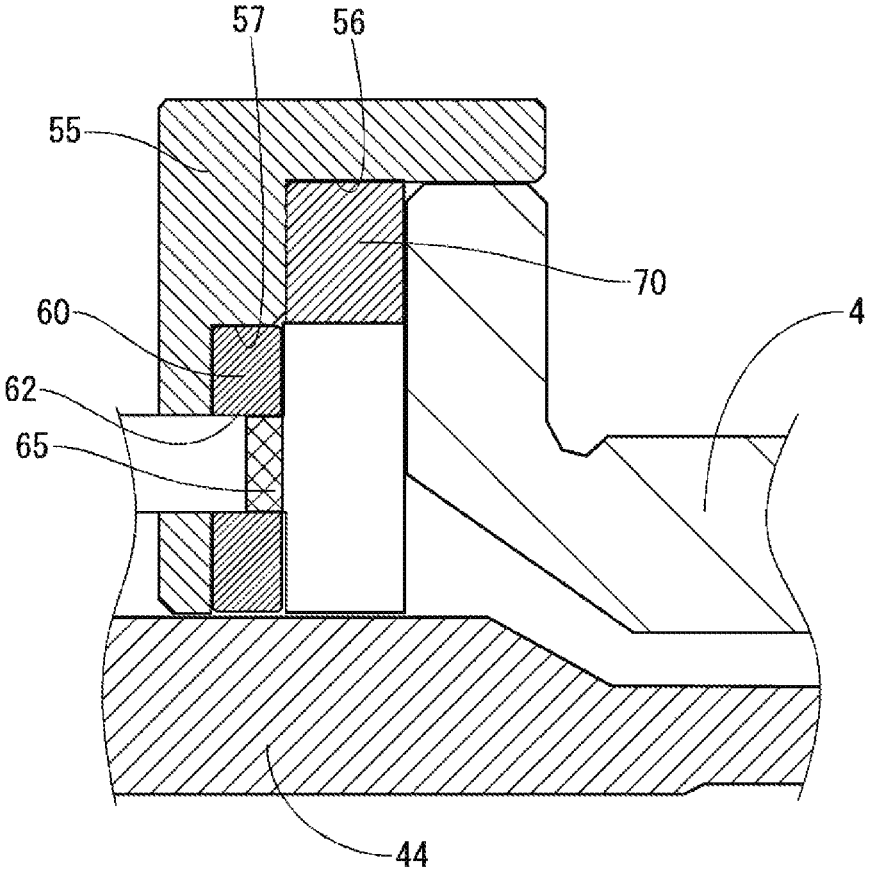
FIG. 5 is an enlarged cross-sectional view of an area V in FIG. 2.
Figure 6:
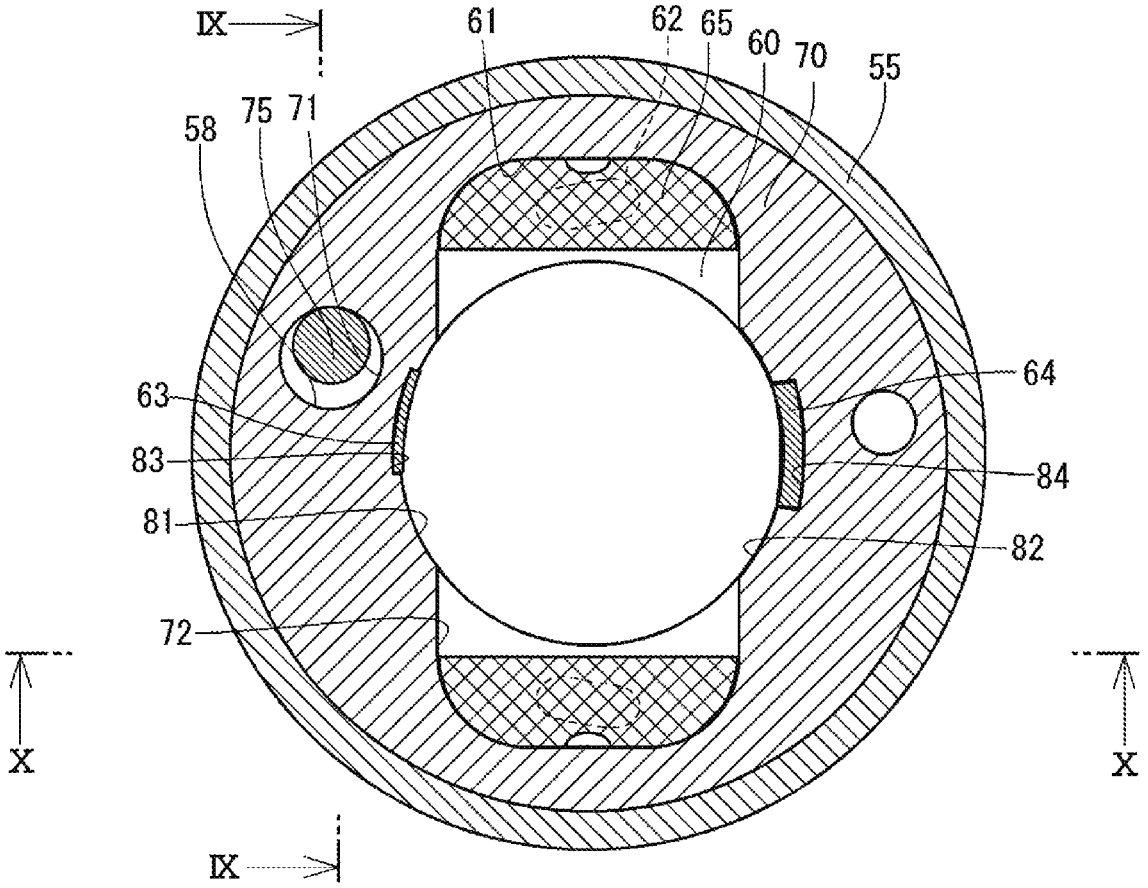
FIG. 6 is an enlarged cross-sectional view taken along line VI-VI in FIG. 2.

As shown in FIGS. 5 and 6, the rotor fixture member 55 includes a fixation recess 56, a holder recess 57 and a rotor fixture hole 58. In FIG. 6, the respective parts are magnified to clarify locations of the respective parts.

The fixation recess 56 is recessed from an axially outer side of the vane rotor 30 toward an axially inner side of the vane rotor 30. Therefore, the fixation recess 56 is a recess that is recessed from the camshaft 4 side toward the vane rotor 30.

The holder recess 57 is a recess that is further recessed from the fixation recess 56 toward the vane rotor 30 side.

Furthermore, the holder recess 57 is shaped to correspond with a shape of the filter holder 60.

As shown in FIG. 6, the rotor fixture hole 58 is communicated with a fitting hole 71 of the shim 70.

Figure 7:
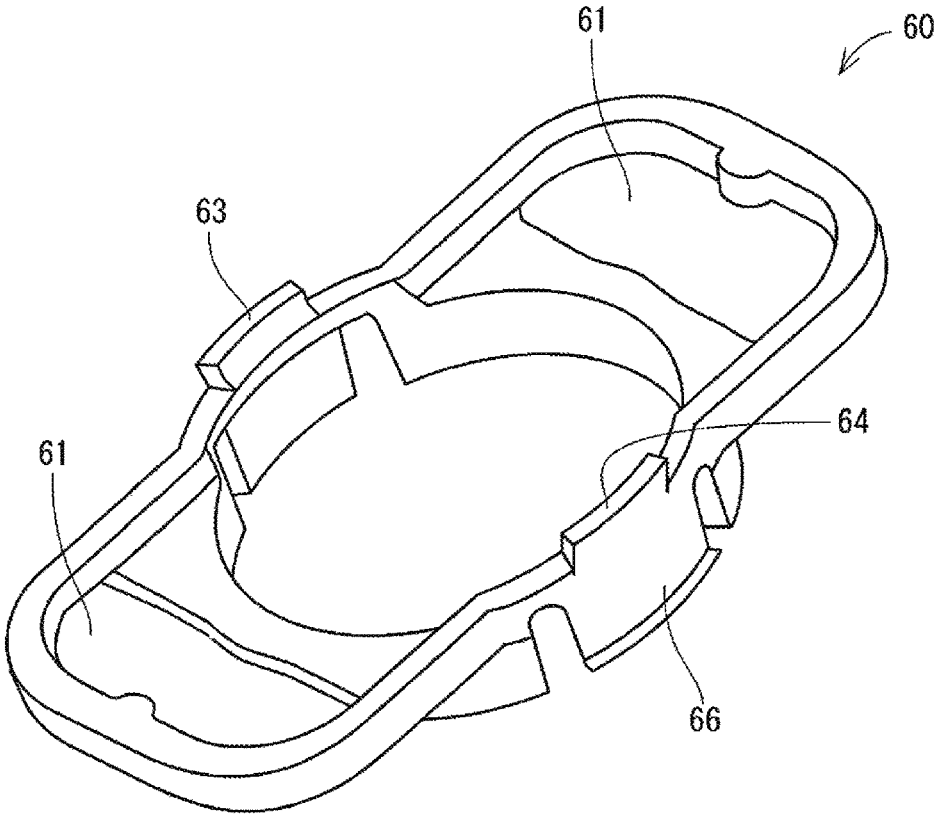
FIG. 7 is an enlarged perspective view of a filter holder of the valve timing adjustment device according to the first embodiment.

As shown in FIG. 7, the filter holder 60 includes an engaging portion 66 that projects toward the rotor fixture member 55.

The engaging portion 66 is configured to engage with the rotor fixture member 55.

Referring back to FIG. 6, the filter holder 60 is fitted into the holder recess 57.

The filter holder 60 includes filter recesses 61, connection oil passages 62, a first filter holding projection 63 and a second filter holding projection 64.

Each of the filter recesses 61 is a recess that is recessed from the camshaft 4 side toward the vane rotor 30 side. The filters 65 are engaged to the filter recesses 61, respectively.

The connection oil passages 62 are formed at the filter recesses 61, respectively, and are configured to connect between the external oil passage 10 and the supply oil passage 37. Holes are formed in the rotor fixture member 55 and are communicated with the connection oil passages 62, respectively.

At the filter holder 60, the first filter holding projection 63 is formed on one side of the center of the filter holder 60 and projects toward the shim 70.

At the filter holder 60, the second filter holding projection 64 is formed on the other side of the center of the filter holder 60 and projects toward the shim 70.

The filters 65 are respectively engaged to the filter recesses 61 and are provided to the filter holder 60.

Furthermore, each filter 65 is in a lattice mesh form.

Each filter 65 is configured to filter the hydraulic oil, which is conducted through the connection oil passage 62, by capturing foreign objects, such as abrasion particles. The filter 65 may be shaped in a mesh form by forming a plurality of circular holes. The filter 65 is formed by an etching process or a press work.

The shim 70 is placed between the camshaft 4 and the filters 65 and contacts the camshaft 4 and the rotor fixture member 55. The shim 70 is configured to adjust a size of a gap between the camshaft 4 and the vane rotor 30. Furthermore, the shim 70 is placed on the upstream side of the filters 65, i.e., is placed on the camshaft 4 side of the filters 65.

A surface of the shim 70 is configured to have a relatively high friction coefficient. The surface of the shim 70 is processed by: a surface treatment, such as a coating; a heat treatment, which increases a hardness of the surface of the shim 70; or adjustment of a texture of the surface of the shim 70.

Furthermore, an outer periphery of the shim 70 is shaped in a circular form and is press fitted into the fixation recess 56, so that the shim 70 is fitted to the rotor fixture member 55.

Figure 8:
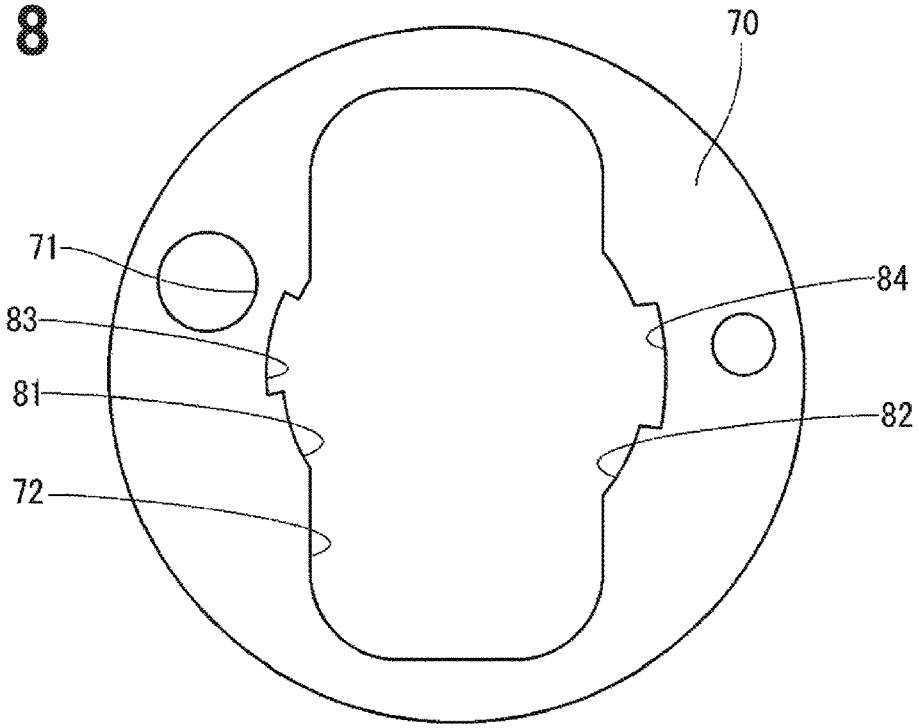
FIG. 8 is an external view of a shim of the valve timing adjustment device according to the first embodiment.

As shown in FIG. 8, the shim 70 is shaped asymmetrically with respect to a radial direction of the shim 70.

The shim 70 has the fitting hole 71, a shim hole 72, a first shim recess 81, a second shim recess 82, a third shim recess 83 and a fourth shim recess 84.

The fitting hole 71 is communicated with the rotor fixture hole 58. A fitting member 75 is inserted into the fitting hole 71 and the rotor fixture hole 58. The shim 70 and the rotor fixture member 55 are further strongly fixed together by the fitting member 75. Here, it should be noted that a hole, which is similar to the rotor fixture hole 58, may be formed at the vane rotor 30, and the fitting member 75 may be inserted into this hole of the vane rotor 30 and the fitting hole 71.

Figure 9:
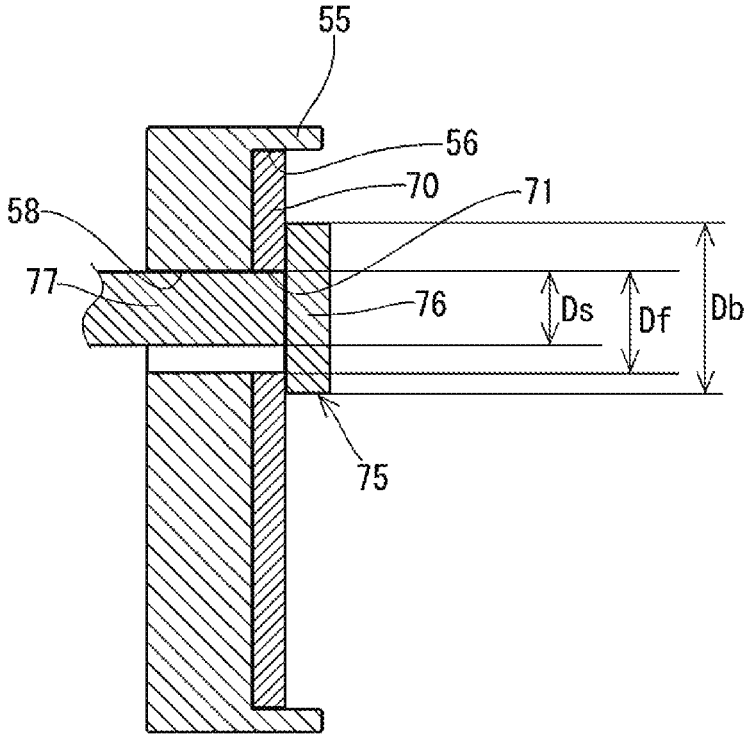
FIG. 9 is a cross-sectional view taken along line IX-IX in FIG. 6.

As shown in FIG. 9, the fitting member 75 includes a large diameter portion 76 and a small diameter portion 77.

The large diameter portion 76 is a portion of the fitting member 75, which is located at the camshaft 4 side. The large diameter portion 76 has a diameter that is larger than a diameter of the small diameter portion 77. The large diameter portion 76 contacts the shim 70.

The small diameter portion 77 is another portion of the fitting member 75, which is located at the opposite side that is opposite to the camshaft 4. The small diameter portion 77 is inserted through the fitting hole 71 and the rotor fixture hole 58.

A diameter of the fitting hole 71 of the shim 70 is indicated by Df. The diameter of the large diameter portion 76 is indicated by Db. The diameter of the small diameter portion 77 is indicated by Ds.

The shim 70 and the fitting member 75 are configured to satisfy the following relationship (1).

$$Ds<Df<Db \quad (1)$$

Referring back to FIG. 8, the shim hole 72 is shaped to extend along an outer periphery of the camshaft 4 side portion of the filter holder 60.

Figure 10:
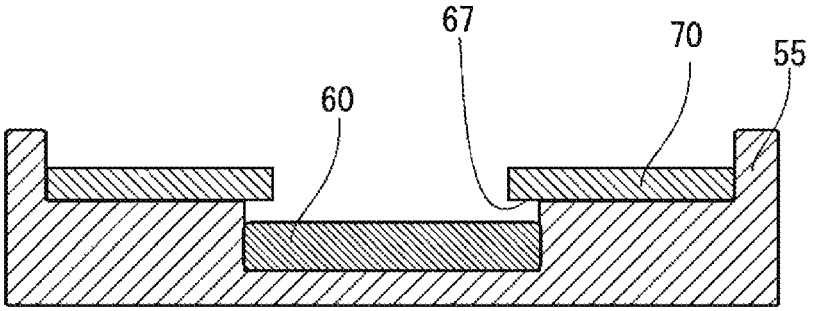
FIG. 10 is a cross-sectional view taken along line X-X in FIG. 6.

As shown in FIG. 10, a gap 67 is formed between the shim 70 and the filter holder 60, and thereby the shim 70 and the filter holder 60 do not contact with each other.

Referring back to FIG. 6, the first shim recess 81 is located at the first filter holding projection 63 side and is formed at an inner side of the shim 70. The first shim recess 81 is recessed from a radially inner side toward a radially outer side of the shim 70.

The second shim recess 82 is located at the second filter holding projection 64 side and is formed at the inner side of the shim 70. The second shim recess 82 is recessed from the radially inner side toward the radially outer side of the shim 70.

The third shim recess 83 is further recessed from the first shim recess 81 toward the radially outer side of the shim 70. The first filter holding projection 63 is engaged with the third shim recess 83, so that the filter holder 60 and the shim 70 are engaged with each other.

The fourth shim recess 84 is further recessed from the second shim recess 82 toward the radially outer side of the shim 70. The second filter holding projection 64 is engaged with the fourth shim recess 84, so that the filter holder 60 and the shim 70 are engaged with each other.

(1) The shim 70 is configured to contact the camshaft 4 and is configured to adjust the size of the gap relative to the camshaft 4. Thereby, the assemblability with the camshaft 4 is improved. Furthermore, the shim 70 is placed between the camshaft 4 and the filters 65. Even when abrasion particles are generated by friction between the shim 70 and the rotor fixture member 55 or the camshaft 4, the abrasion particles are captured by the filters 65, and thereby the hydraulic oil is filtered. Therefore, the intrusion of the abrasion particles into the inside of the valve timing adjustment device 11 is limited, and thereby occurrence of the malfunction of the valve timing adjustment device 11 is limited.

(2) A fixture member, which is connected to the camshaft, has been previously proposed. It is conceivable to provide the shim of the previously proposed valve timing adjustment device discussed earlier to this fixture member. However, even when this fixture member and this shim are combined, there is a possibility that friction is generated between this shim and the camshaft or this fixture member, and thereby generating a relatively large amount of abrasion particles.

In view of the above point, the shim 70 is engaged with the filter holder 60 through the first filter holding projection 63 and the second filter holding projection 64. Thereby, the shim 70 can be assembled to the valve timing adjustment device 11 with one touch. Thus, the friction between the shim 70 and the valve timing adjustment device 11 is limited. It is not required to form the groove of the fixture member of the previously proposed valve timing adjustment device, and thereby it is possible to reduce the amount of wear of the shim 70 or the valve timing adjustment device 11.

Furthermore, the shim 70 can be installed to the rotor fixture member 55 without causing the resilient deformation of the shim 70. Therefore, plastic deformation of the shim 70 or peeling of the coating can be reduced, and damage to the shim 70 can be limited. Furthermore, the installation of the shim 70 is eased, and replacement of the shim 70 is eased.

(3) The shim 70 is coupled to the rotor fixture member 55 by the fitting member 75. Thereby, the fixation force between the shim 70 and the rotor fixture member 55 is enhanced. Similar to the advantage discussed at the above section (2), the shim 70 can be installed to the rotor fixture member 55 without causing the resilient deformation of the shim 70. Therefore, plastic deformation of the shim 70 or peeling of the coating can be reduced, and damage to the shim 70 can be limited. Furthermore, the fitting member 75, which serves as a positioning member, can be used, so that the assembling of the camshaft 4 and the valve timing adjustment device 11 can be eased. Furthermore, since the positioning is eased, the friction of the shim 70 is reduced, and thereby the amount of wear can be reduced.

(4) The shim 70 is shaped asymmetrically with respect to the radial direction of the shim 70. Therefore, at the time of fitting the shim 70 to the rotor fixture member 55, the front side and the back side as well as the up side, the down side, the left side and the right side of the shim 70 can be uniquely determined. Thus, it is possible to limit an error in the orientation of the shim 70 at the time of assembling the internal combustion engine 1 and the valve timing adjustment device 11 together.

Second Embodiment

The second embodiment is the same as the first embodiment except that the filter holder is eliminated, and the shapes of the filters and the shim are different from those of the first embodiment.

Figure 11:
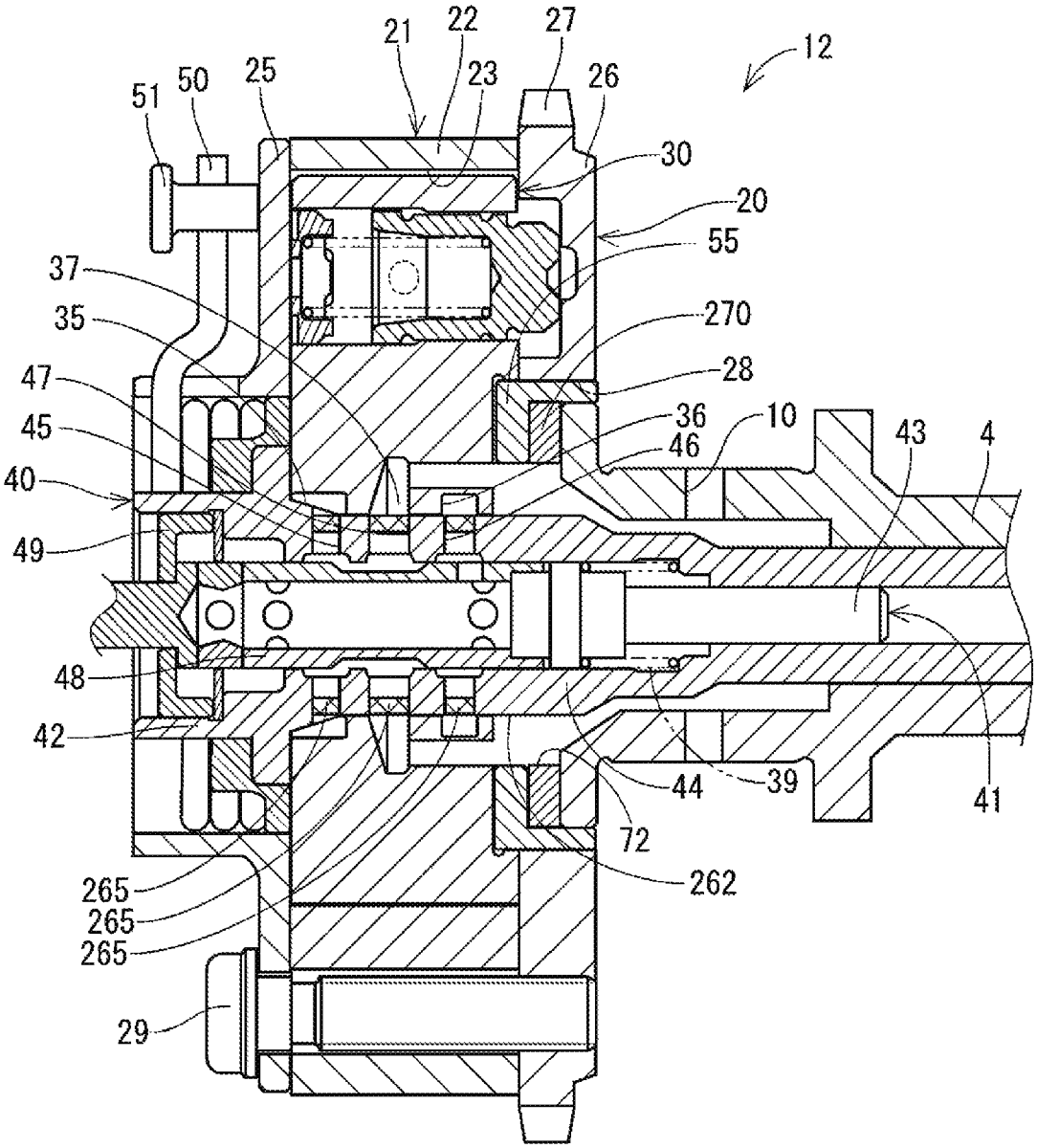
FIG. 11 is a cross-sectional view showing a valve timing adjustment device according to a second embodiment.

As shown in FIG. 11, the filters 265 of the valve timing adjustment device 12 of the second embodiment are placed at the sleeve portion 44.

One of the filters 265 is wound around the advance ports 45 and covers the advance ports 45. Another one of the filters 265 is wound around the retard ports 46 and covers the retard ports 46. Another one of the filters 265 is wound around the supply ports 47 and covers the supply ports 47. Therefore, intrusion of the foreign objects, such as the abrasion particles, into the advance chambers 33 or the retard chambers 34 can be limited.

The shim 270 is shaped in a ring form. The shim hole 72 is communicated with a hole that is formed at the center of the rotor fixture member 55. A connection oil passage 262 is formed between: an inner surface of the shim 270 and an inner surface of the rotor fixture member 55; and an outer surface of the sleeve bolt 41.

Even in the second embodiment, it is possible to achieve the advantage that is the same as the advantage of the first embodiment recited at the above section (1).

Third Embodiment

The third embodiment is the same as the second embodiment except the configurations of the filters.

Figure 12:
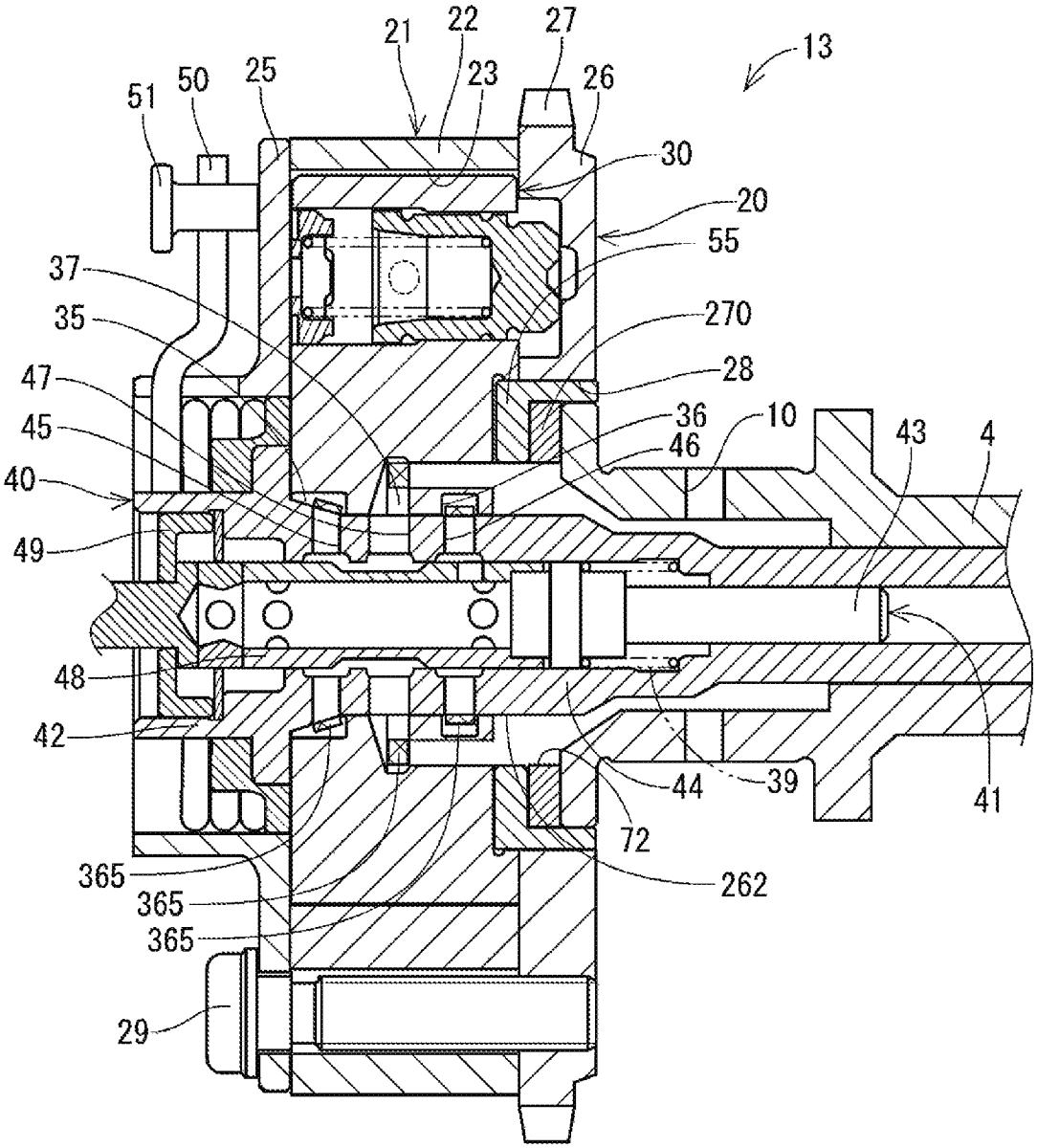
FIG. 12 is a cross-sectional view showing a valve timing adjustment device according to a third embodiment.

As shown in FIG. 12, the filters 365 of the valve timing adjustment device 13 of the third embodiment are installed to the vane rotor 30.

The filters 365 are installed at the inside of the vane rotor 30 and are provided to the advance oil passage 35, the retard oil passage 36 and the supply oil passage 37, respectively. Alternatively, the filters 365 may be installed at the outside of the vane rotor 30. In this way, intrusion of the foreign objects, such as the abrasion particles, into the advance chambers 33 or the retard chambers 34 can be limited.

Even in the third embodiment, it is possible to achieve the advantage that is the same as the advantage of the first embodiment recited at the above section (1).

Fourth Embodiment

The fourth embodiment is the same as the second embodiment except the configuration of the filter.

Figure 13:
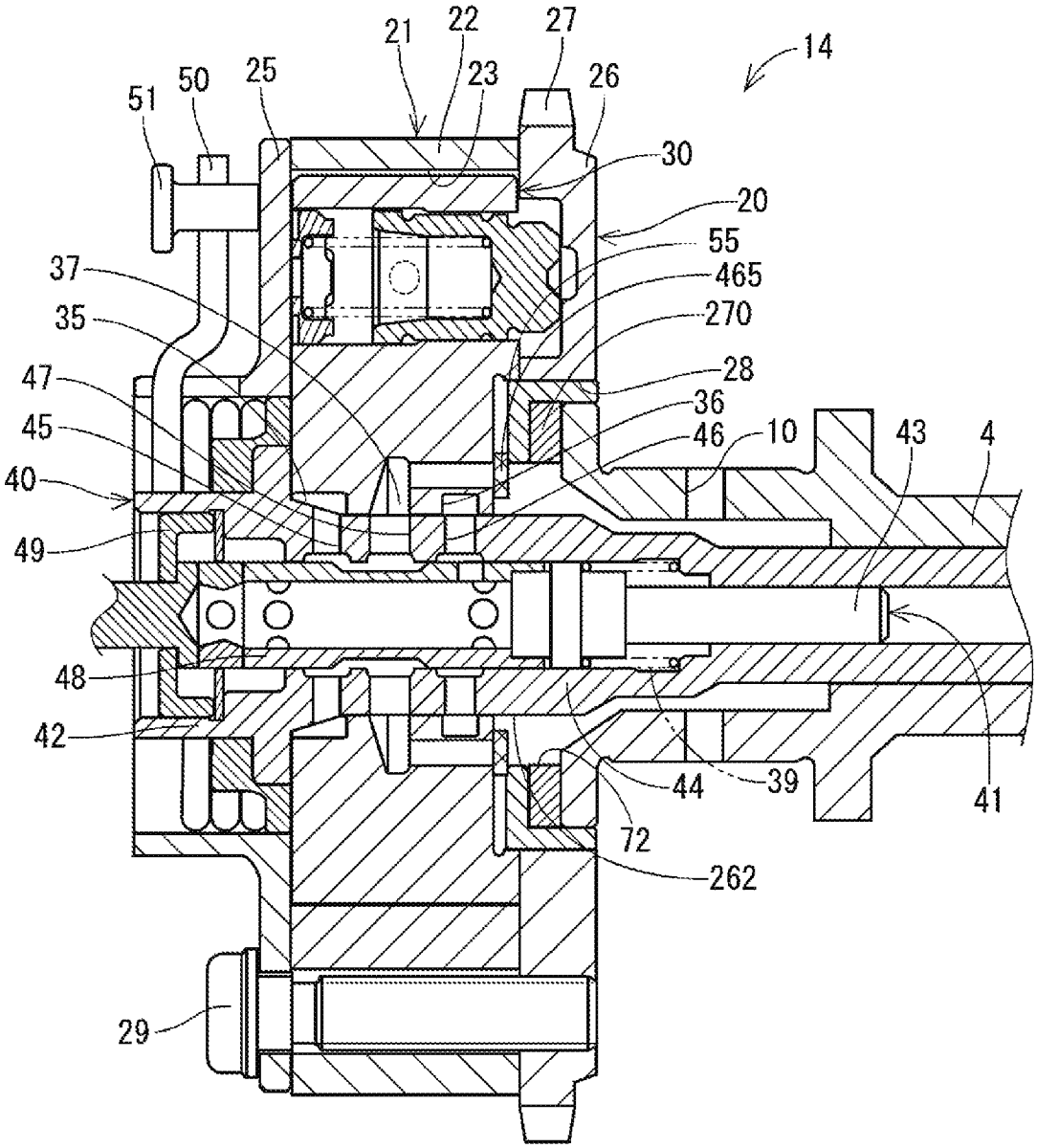
FIG. 13 is a cross-sectional view showing a valve timing adjustment device according to a fourth embodiment.

As shown in FIG. 13, the filter 465 of the valve timing adjustment device 14 of the fourth embodiment is clamped between the rotor fixture member 55 and the vane rotor 30.

The filter 465 is installed to the end surface of the rotor fixture member 55, which is opposite to the camshaft 4. In this way, the foreign objects, which flow in the connection oil passage 262, can be captured. Thus, intrusion of the foreign objects, such as the abrasion particles, into the advance chambers 33 or the retard chambers 34 can be limited.

Even in the fourth embodiment, it is possible to achieve the advantage that is the same as the advantage of the first embodiment recited at the above section (1).

Fifth Embodiment

The fifth embodiment is the same as the first embodiment except the configuration of the shim.

Figure 14:
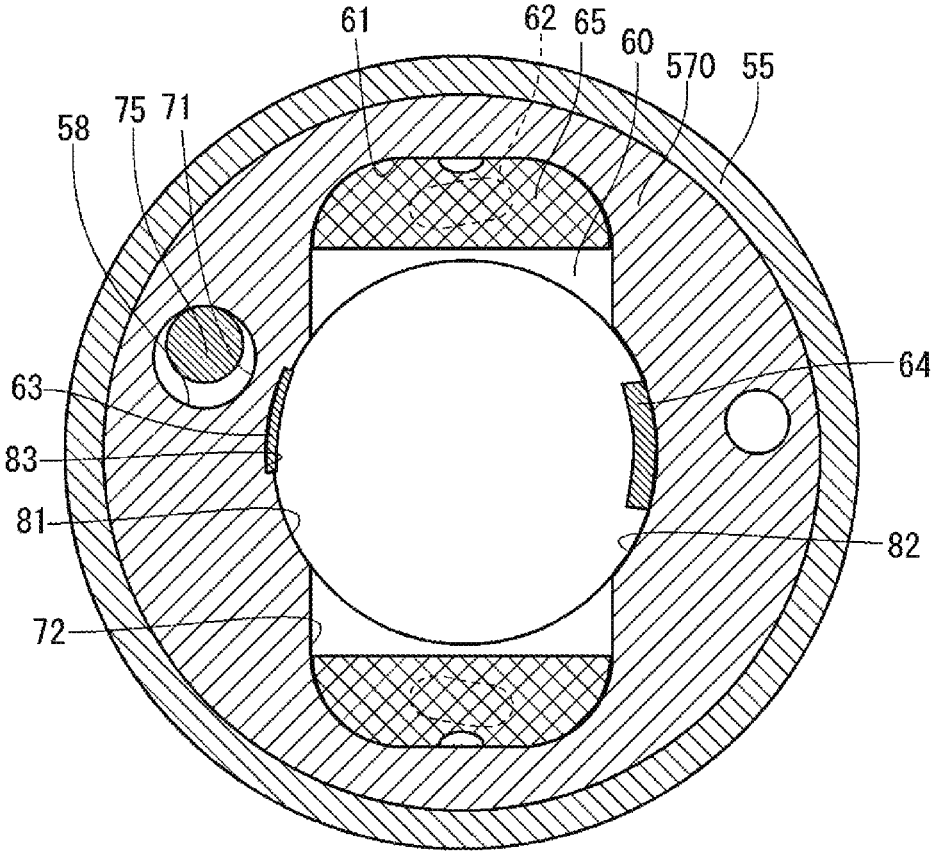
FIG. 14 is an enlarged cross-sectional view of a rotor fixture member, a filter holder and a shim of a valve timing adjustment device according to a fifth embodiment.

As shown in FIG. 14, the shim 570 of the fifth embodiment has the first shim recess 81, the second shim recess 82 and the third shim recess 83 but does not have the fourth shim recess 84.

The second filter holding projection 64 is engaged to the second shim recess 82, and the shim 570 and the filter holder 60 are engaged with each other.

Even in the fifth embodiment, it is possible to achieve the advantage that is the same as the advantage of the first embodiment recited at the above section (2).

Sixth Embodiment

The sixth embodiment is the same as the first embodiment except the configuration of the shim.

Figure 15:
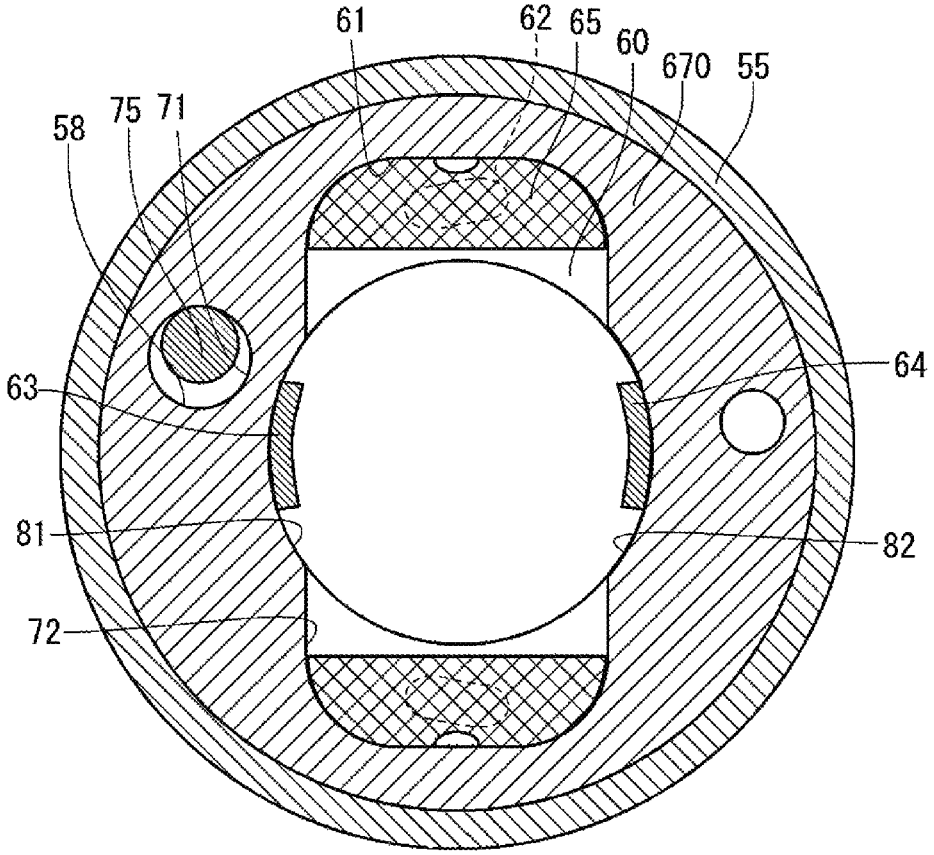
FIG. 15 is an enlarged cross-sectional view of a rotor fixture member, a filter holder and a shim of a valve timing adjustment device according to a sixth embodiment.

As shown in FIG. 15, the shim 670 of the sixth embodiment has the first shim recess 81 and the second shim recess 82 but does not have the third shim recess 83 and the fourth shim recess 84.

The shim 670 is shaped symmetrically.

The first filter holding projection 63 is formed at a location that corresponds to the first shim recess 81.

The second filter holding projection 64 is formed at a location that corresponds to the second shim recess 82.

Similar to the shim 670, the filter holder 60 is shaped symmetrically.

The first filter holding projection 63 is engaged with the first shim recess 81. The second filter holding projection 64 is engaged with the second shim recess 82. In this way, the shim 670 and the filter holder 60 are engaged with each other.

Even in the sixth embodiment, it is possible to achieve the advantage that is the same as the advantage of the first embodiment recited at the above section (2).

Seventh Embodiment

The seventh embodiment is the same as the first embodiment except that the filter holder is absent in the seventh embodiment, and the configuration of the camshaft of the internal combustion engine, the configuration of the shim and the configuration of the filter are different from those of the first embodiment.

Figure 16:
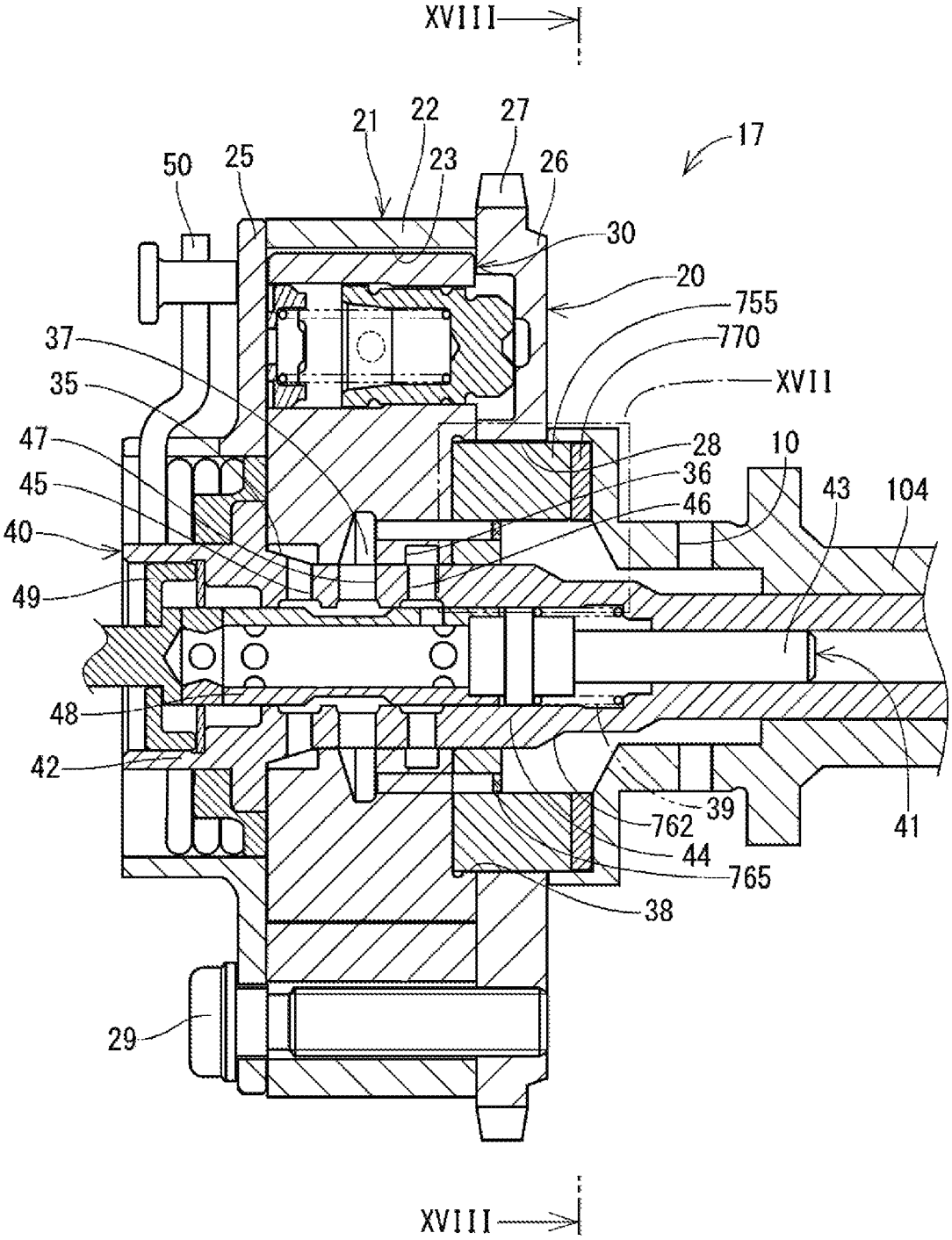
FIG. 16 is a cross-sectional view showing a valve timing adjustment device according to a seventh embodiment.

As shown in FIG. 16, the valve timing adjustment device 17 of the seventh embodiment is connected to the camshaft 104.

The valve timing adjustment device 17 does not have the filter holder.

The camshaft 104, which serves as the driven shaft of the internal combustion engine 1, includes a driven shaft recess 106 and a driven shaft hole 107.

Figure 17:
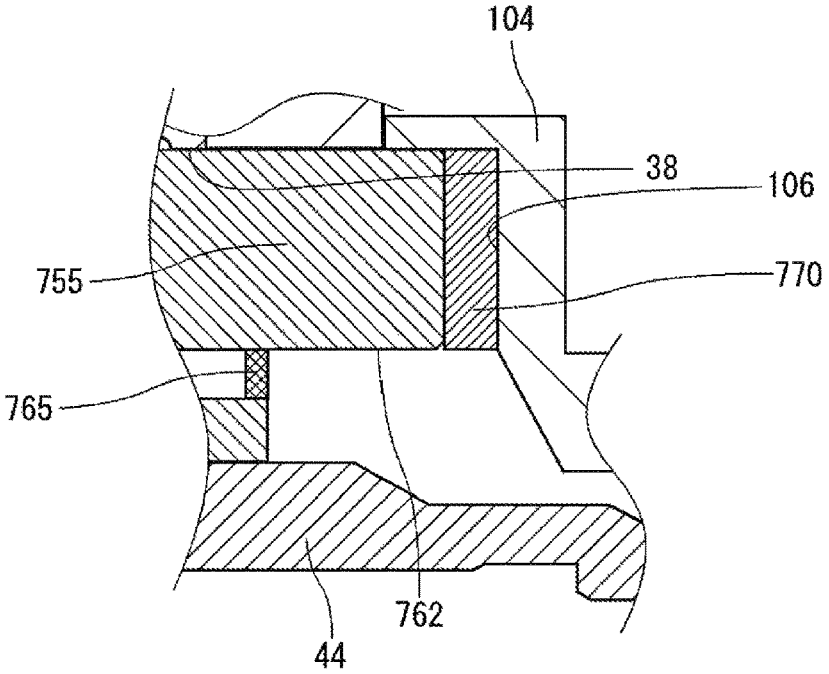
FIG. 17 is an enlarged view of an area XVII in FIG. 16.

As shown in FIG. 17, the driven shaft recess 106 is recessed from the axially outer side toward the axially inner side of the camshaft 104, i.e., is recessed from the vane rotor 30 side toward the camshaft 104 side.

Figure 18:
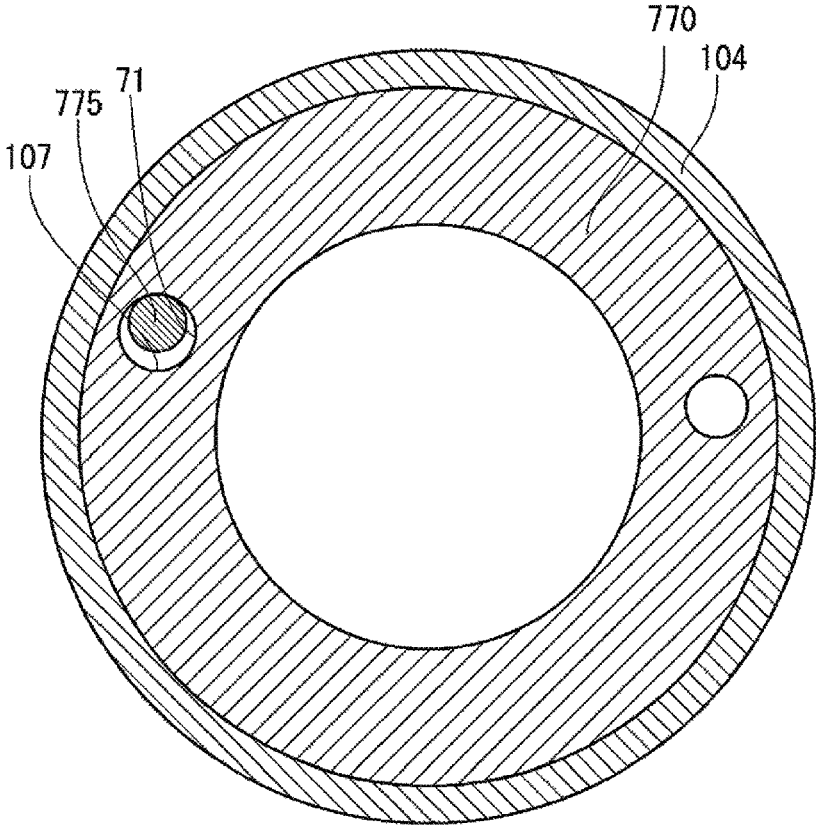
FIG. 18 is an enlarged cross-sectional view taken along line XVIII-XVIII in FIG. 16.

As shown in FIG. 18, the driven shaft hole 107 is formed at a location that corresponds to the fitting hole 71 of the shim 770 and is communicated with the fitting hole 71. The fitting member 775 is inserted into the driven shaft hole 107 and the fitting hole 71, and thereby the camshaft 104 and the shim 770 are coupled together.

The shim 770 is shaped in a ring form.

Furthermore, the shim 770 is installed to the camshaft 104 and is press fitted into the driven shaft recess 106.

Referring back to FIG. 17, a connection oil passage 762 is formed between: an inner surface of the shim 770 and an inner surface of the rotor fixture member 755; and the outer surface of the sleeve bolt 41.

Holes are formed in the rotor fixture member 755 and are communicated with the connection oil passage 762.

The filter 765 is installed to the rotor fixture member 755.

The filter 765 captures the foreign objects, which flow in the connection oil passage 762. Here, it should be noted that there may be provided three filters 765. One of the filters 765 may be wound around the advance ports 45 and covers the advance ports 45. Another one of the filters 765 may be wound around the retard ports 46 and covers the retard ports 46. Another one of the filters 765 may be wound around the supply ports 47 and covers the supply ports 47. Furthermore, the filters 765 may be provided to the advance oil passage 35, the retard oil passage 36 and the supply oil passage 37, respectively.

Even in the seventh embodiment, it is possible to achieve the advantages that are the same as the advantages of the first embodiment recited at the above sections (1) and (3).

Other Embodiments (i) The filter(s) is/are not necessarily installed to the filter holder, the advance oil passage, the retard oil passage, the supply oil passage, the advance port, the retard ports and/or the supply ports. The installation location(s) of the filter(s) is/are not necessarily limited to any location(s). It is only required that the shim is placed between the camshaft and the filter(s).

Figure 19:
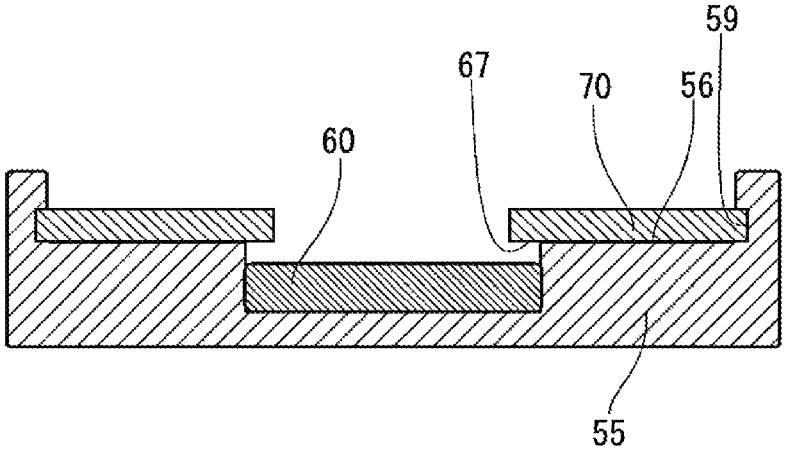
FIG. 19 is an enlarged cross-sectional view of a rotor fixture member, a filter holder and a shim of a valve timing adjustment device according to another embodiment.

(ii) As shown in FIG. 19, a groove 59 may be formed at an inner surface of the fixation recess 56 of the rotor fixture member 55. The fixation force between the rotor fixture member 55 and the shim 70 can be enhanced by inserting the shim 70 into the fixation recess 56 such that the shim 70 is engaged with the groove 59. Even in the case where the groove 59 is provided, due to the advantage recited in the above section (1), the intrusion of the abrasion particles into the inside of the valve timing adjustment device is limited even if the shim 70 is worn, and thereby occurrence of the malfunction of the valve timing adjustment device is limited.

As discussed above, the present disclosure should not be limited to the above embodiments and can be implemented in various forms without departing from the scope thereof.

The present disclosure has been described with reference to the embodiments. However, the present disclosure should not be limited to the embodiments and the structures described therein. The present disclosure covers various modifications and variations on the scope of equivalents.

Also, various combinations and forms as well as other combinations, each of which includes only one element or more or less of the various combinations, are also within the scope and spirit of the present disclosure.

What is claimed is:

1. A valve timing adjustment device for transmitting a drive force from a drive shaft to a driven shaft of an internal combustion engine and for adjusting a valve timing of the internal combustion engine through the driven shaft, the valve timing adjustment device comprising:

a sprocket configured to rotate;

a vane rotor received in the sprocket so as to rotate relative to the sprocket such that a rotational phase between the drive shaft and the driven shaft is changed when the vane rotor is rotated relative to the sprocket, wherein the vane rotor includes a supply oil passage configured to communicate with an external oil passage;

an oil-passage change valve placed on a radially inner side of the vane rotor and configured to alternately enable and block a communication between the external oil passage and the supply oil passage, wherein the oil-passage change valve includes a sleeve and a spool, and the spool is received in the sleeve and is configured to reciprocate;

a filter configured to filter hydraulic oil conducted in a connection oil passage that connects the external oil passage to the supply oil passage; and a shim placed between the driven shaft and the filter and contacts the driven shaft, wherein:

the shim is located on a side of the vane rotor where the driven shaft is placed in an axial direction of the driven shaft such that the shim is configured to adjust a size of a gap between the driven shaft and the vane rotor in the axial direction;

the shim has a processed surface that is processed to have a relatively high friction coefficient which is higher in comparison to a case where a surface of the shim is not processed;

the shim is entirely spaced away from the sleeve in a radial direction such that a clearance is defined between the shim and the sleeve at least partially along a circumferential extent of the sleeve; and the filter is configured to capture abrasion particles generated by the shim.

2. The valve timing adjustment device according to claim 1, wherein the filter is arranged in the oil-passage change valve.

3. The valve timing adjustment device according to claim 1, wherein the filter is arranged in the vane rotor.

4. The valve timing adjustment device according to claim 1, further comprising a rotor fixture fixed to the vane rotor and configured to directly connect with the driven shaft such that the shim is axially clamped between a wall of the rotor fixture and the driven shaft in the axial direction.

5. The valve timing adjustment device according to claim 4, wherein:

the rotor fixture has a fixation recess; and the shim is fitted into the fixation recess.

6. The valve timing adjustment device according to claim 4, further comprising a filter holder coupled to the rotor fixture so as to hold the filter.

7. The valve timing adjustment device according to claim 6, wherein:

the filter holder includes a filter holding projection that projects toward the shim; and the shim has a shim hole configured to engage the filter holding projection.

8. The valve timing adjustment device according to claim 1, wherein:

the shim has a fitting hole; and a fitting pin is inserted into the fitting hole.

9. The valve timing adjustment device according to claim 1, wherein the shim is coupled to the driven shaft.

10. The valve timing adjustment device according to claim 9, wherein:

the driven shaft has a driven shaft recess; and the shim is fitted into the driven shaft recess.

11. The valve timing adjustment device according to claim 9, wherein:

the driven shaft has a driven shaft hole;

the shim has a fitting hole that communicates with the driven shaft hole; and a fitting pin is inserted into the driven shaft hole and the fitting hole so as to couple the shim to the driven shaft.

12. The valve timing adjustment device according to claim 1, further comprising a rotor fixture formed integrally in one-piece, wherein the rotor fixture has one contact surface and another contact surface, which are opposed to each other in the axial direction and respectively contact the vane rotor and the shim in the axial direction.

13. The valve timing adjustment device according to claim 1, wherein:

the filter is one of a plurality of filters;

the shim has a single shim hole that is an only hole which extends through the shim in the axial direction to conduct the hydraulic oil toward the plurality of filters; and more than half of each of the plurality of filters is directly opposed to the single shim hole in the axial direction.

14. The valve timing adjustment device according to claim 1, wherein the filter and the vane rotor are positioned on one side of the shim in the axial direction and the driven shaft is positioned on an opposite side of the shim in the axial direction.

15. The valve timing adjustment device according to claim 1, wherein the vane rotor is entirely positioned on one side of the shim in the axial direction and the driven shaft is entirely positioned on an opposite side of the shim in the axial direction so that there is no overlap between the positioning of the vane rotor and the shim in the axial direction and there is no overlap between the positioning of the driven shaft and the shim in the axial direction.

16. A valve timing adjustment device for transmitting a drive force from a drive shaft to a driven shaft of an internal combustion engine and for adjusting a valve timing of the internal combustion engine through the driven shaft, the valve timing adjustment device comprising:

a sprocket configured to rotate;

a vane rotor received in the sprocket so as to rotate relative to the sprocket such that a rotational phase between the drive shaft and the driven shaft is changed when the vane rotor is rotated relative to the sprocket, wherein the vane rotor includes a supply oil passage configured to communicate with an external oil passage;

an oil-passage change valve placed on a radially inner side of the vane rotor and configured to alternately enable and block a communication between the external oil passage and the supply oil passage, wherein the oil-passage change valve includes a sleeve and a spool, and the spool is received in the sleeve and is configured to reciprocate;

a filter configured to filter hydraulic oil conducted in a connection oil passage that connects the external oil passage to the supply oil passage; and a shim placed between the driven shaft and the filter and contacts the driven shaft, wherein:

the shim is located on a side of the vane rotor where the driven shaft is placed in an axial direction of the driven shaft such that the shim is configured to adjust a size of a gap between the driven shaft and the vane rotor in the axial direction;

the shim has a processed surface that is processed to have a relatively high friction coefficient which is higher in comparison to a case where a surface of the shim is not processed;

the shim is entirely spaced away from the sleeve, and a radial gap is formed between the shim and the sleeve along an entire circumferential extent of the sleeve;

the filter is configured to capture abrasion particles generated by the shim; and the valve timing adjustment device further comprises a rotor fixture formed integrally in one-piece, wherein the rotor fixture has one contact surface and another contact surface, which are opposed to each other in the axial direction and respectively contact the vane rotor and the shim in the axial direction.

17. A valve timing adjustment device for transmitting a drive force from a drive shaft to a driven shaft of an internal combustion engine and for adjusting a valve timing of the internal combustion engine through the driven shaft, the valve timing adjustment device comprising:

a sprocket configured to rotate;

a vane rotor received in the sprocket so as to rotate relative to the sprocket such that a rotational phase between the drive shaft and the driven shaft is changed when the vane rotor is rotated relative to the sprocket, wherein the vane rotor includes a supply oil passage configured to communicate with an external oil passage;

an oil-passage change valve placed on a radially inner side of the vane rotor and configured to alternately enable and block a communication between the external oil passage and the supply oil passage, wherein the oil-passage change valve includes a sleeve and a spool, and the spool is received in the sleeve and is configured to reciprocate;

a filter configured to filter hydraulic oil conducted in a connection oil passage that connects the external oil passage to the supply oil passage; and a shim placed between the driven shaft and the filter and contacts the driven shaft, wherein:

the shim is located on a side of the vane rotor where the driven shaft is placed in an axial direction of the driven shaft such that the shim is configured to adjust a size of a gap between the driven shaft and the vane rotor in the axial direction;

the shim has a processed surface that is processed to have a relatively high friction coefficient which is higher in comparison to a case where a surface of the shim is not processed;

the shim is entirely spaced away from the sleeve, and a radial gap is formed between the shim and the sleeve along an entire circumferential extent of the sleeve;

the filter is configured to capture abrasion particles generated by the shim;

the filter is one of a plurality of filters;

the shim has a single shim hole that is an only hole which extends through the shim in the axial direction to conduct the hydraulic oil toward the plurality of filters; and more than half of each of the plurality of filters is directly opposed to the single shim hole in the axial direction.

* * * * *